US010210780B2

(12) United States Patent
Williams, Jr.

(10) Patent No.: US 10,210,780 B2
(45) Date of Patent: Feb. 19, 2019

(54) METHOD OF MOUNTING A FLAG HOLDER MOUNT ONTO A MOTORCYCLE

(71) Applicant: Roy E. Williams, Jr., San Antonio, TX (US)

(72) Inventor: Roy E. Williams, Jr., San Antonio, TX (US)

( * ) Notice: Subject to any disclaimer, the term of this patent is extended or adjusted under 35 U.S.C. 154(b) by 0 days.

(21) Appl. No.: 14/670,775

(22) Filed: Mar. 27, 2015

(65) Prior Publication Data

US 2016/0284253 A1 Sep. 29, 2016

(51) Int. Cl.
*G09F 17/00* (2006.01)

(52) U.S. Cl.
CPC ..... *G09F 17/00* (2013.01); *G09F 2017/0066* (2013.01); *G09F 2017/0075* (2013.01)

(58) Field of Classification Search
CPC ..... G09F 17/00; A01K 97/10
USPC ..... 116/173–175, 28 R; 40/588, 591
See application file for complete search history.

(56) References Cited

U.S. PATENT DOCUMENTS 466,960 A * 1/1892 Widmayer ..... A01K 97/10 248/315
545,385 A * 8/1895 Simpson ..... A01K 97/10 248/513
1,025,904 A 5/1912 Earhart
D46,417 S * 9/1914 Tice ..... D11/182
1,281,748 A * 10/1918 America ..... A01K 97/10 248/538
1,632,726 A * 6/1927 Conklin ..... E04H 12/32 211/70.1
2,139,188 A * 12/1938 Haislip ..... A01K 97/10 224/200
2,174,140 A * 9/1939 Schofield ..... A47L 13/24 248/224.51
2,292,523 A * 8/1942 Hynek ..... B60R 13/00 248/208
2,324,614 A * 7/1943 Dalton ..... B60Q 1/2657 116/173
2,680,588 A * 6/1954 Wright ..... B60R 13/00 116/173
2,753,439 A * 7/1956 Greenfield ..... B60Q 1/484 116/28 R
2,794,414 A * 6/1957 Reifschneider ..... E04H 12/32 116/173

(Continued)

*Primary Examiner* — R. A. Smith
*Assistant Examiner* — Tania Courson
(74) *Attorney, Agent, or Firm* — Miguel Villarreal, Jr.; Gunn, Lee & Cave, P.C.

(57) ABSTRACT

A flag holder mount comprising a hollow cylindrical main body, a pad mount and a connecting bar connecting the pad mount to the cylindrical main body so as to comprise a single piece. When mounted to the center of gravity portion of the frame of a motorcycle, the flag holder angles away from the motorcycle and angles back toward the rear of the motorcycle. In an alternative embodiment, the flag holder includes a post mount comprising a connector having a closed end and includes an aperture therein adapted to receive a pin or other comparable fastener to connect the connector of the post mount to the passenger foot peg support. In an alternative embodiment, the flag holder may have a pre-angled connector, or post mount, adapted to receive the pre-angled foot peg support extending from the frame of the motorcycle.

2 Claims, 8 Drawing Sheets

(56) References Cited

U.S. PATENT DOCUMENTS 2,803,387 A * 8/1957 Pearce ..... A01K 97/10 224/200
3,047,262 A * 7/1962 Ripich ..... A01K 97/10 248/538
3,099,243 A * 7/1963 Schwartz ..... B62J 3/00 116/28 R
3,162,409 A 12/1964 Straayer et al.
3,167,284 A 1/1965 Lynch
3,304,035 A 2/1967 Davis
D208,365 S * 8/1967 Federighi ..... D15/81
3,812,815 A * 5/1974 Kuenzel ..... B62J 6/00 116/173
3,825,214 A 7/1974 Ciolfi
D233,036 S * 10/1974 Hoover, Jr. ..... D22/147
3,945,336 A * 3/1976 Harris ..... B62J 27/00 116/28 R
3,947,059 A * 3/1976 Gillilan, Jr. ..... B62J 11/00 116/173
3,967,575 A * 7/1976 Coutts ..... B62J 27/00 116/35 A
4,041,452 A * 8/1977 Moya ..... B60Q 1/2657 116/28 R
4,115,942 A * 9/1978 Sears ..... B62J 6/00 116/56
4,158,925 A * 6/1979 Gagnon ..... G09F 21/04 116/28 R
4,274,127 A * 6/1981 Beck ..... B62J 6/00 116/173
4,365,581 A * 12/1982 Margiloff ..... B60Q 1/36 116/52
4,468,878 A * 9/1984 Maher ..... A01K 97/10 248/338
4,582,017 A * 4/1986 Ostermiller ..... B60R 13/00 116/28 R
4,632,354 A * 12/1986 Asciutto ..... B62J 99/00 116/173
D296,542 S 7/1988 Bineford
D306,396 S * 3/1990 Brushaber ..... 114/230.11
D307,171 S * 4/1990 Engle ..... D22/147
4,927,117 A * 5/1990 Gainey ..... A45B 11/00 135/88.01
5,002,298 A * 3/1991 Motto ..... B62M 1/12 280/233
5,039,056 A 8/1991 Paxton
5,105,574 A * 4/1992 Fast ..... A01K 97/10 43/21.2
5,231,785 A * 8/1993 Roberts ..... A01K 97/10 248/538
D340,676 S * 10/1993 Gallagher ..... D11/181
D344,447 S * 2/1994 Kuehl ..... D11/182
5,321,904 A * 6/1994 Benson ..... A01K 97/10 211/70.8
5,335,621 A 8/1994 Willis et al.
D377,387 S * 1/1997 Mathewson ..... D22/147
5,732,927 A 3/1998 Purpura
5,871,196 A * 2/1999 Martelli ..... A01K 97/10 248/514
6,131,427 A * 10/2000 Webber ..... B62H 5/18 280/297
6,357,166 B1 * 3/2002 Malmanger ..... A01K 97/10 43/21.2
6,481,366 B1 * 11/2002 Patera ..... G09F 17/00 116/173
D479,161 S 9/2003 Halbert
6,964,403 B2 * 11/2005 Fox ..... G09F 17/00 116/173
6,974,113 B1 * 12/2005 Clark ..... A01K 97/10 248/521
7,172,164 B2 * 2/2007 Fuelling ..... A01K 97/10 248/309.1
7,234,411 B1 * 6/2007 Butler ..... A42B 3/0406 116/173
7,278,233 B2 * 10/2007 Melville ..... A01K 97/10 248/512
7,293,523 B1 * 11/2007 Lentz ..... G09F 21/04 116/173
D578,057 S 10/2008 Frenock
7,654,218 B1 * 2/2010 Marlette ..... G09F 17/00 116/173
7,743,725 B2 * 6/2010 Kengerski ..... A42B 3/04 116/173
7,841,124 B2 * 11/2010 Wegman ..... A01K 97/10 43/21.2
7,891,849 B2 * 2/2011 Campbell ..... B60Q 1/2661 362/473
8,272,659 B2 * 9/2012 Meredith ..... B62K 19/08 280/288.4
8,327,575 B1 * 12/2012 Zalewski ..... 248/519
8,727,298 B2 * 5/2014 Shaffstall ..... B62J 11/00 248/519
8,857,084 B2 * 10/2014 Courter ..... G09F 21/048 280/288.4
9,771,114 B1 * 9/2017 Malsam ..... B62J 25/00
2005/0028722 A1 * 2/2005 Arntz ..... G09F 17/00 116/173
2006/0096519 A1 * 5/2006 Drake ..... A01M 29/06 116/22 A
2006/0118693 A1 6/2006 Fisher et al.
2007/0101922 A1 * 5/2007 Kengerski ..... G09F 17/00 116/28 R
2008/0084590 A1 4/2008 Mack
2009/0031600 A1 * 2/2009 Anderson, II ..... G09F 17/00 40/606.03
2009/0165698 A1 * 7/2009 Lapkin ..... G09F 17/00 116/173
2010/0263583 A1 * 10/2010 Nihra ..... G09F 17/00 116/173
2011/0203510 A1 * 8/2011 Dover ..... B63B 45/00 116/26
2011/0272552 A1 11/2011 Jeffries
2012/0187166 A1 7/2012 Cook
2015/0213741 A1 * 7/2015 Bigham ..... G09F 17/00 116/173
2015/0366180 A1 * 12/2015 Chmura ..... A01K 97/10 248/514

* cited by examiner

METHOD OF MOUNTING A FLAG HOLDER MOUNT ONTO A MOTORCYCLE

CROSS REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

This invention is related to a flag holder, and more particularly to a flag holder mount for holding at least one flag mounted to a motorcycle.

2. Description of the Related Art

Motorcycles—also called motorbikes or bikes—are traditionally two-wheeled motorized vehicles, but some models include three-wheeled versions called "trikes." As used herein, the term "motorcycle" includes "trikes." Motorcycle enthusiasts enjoy riding their motorcycles on any occasion. Several motorcycle enthusiasts are also very patriotic and want to show off their American flag. They regularly participate in riding groups and in parades where several of the motorcyclists proudly display and exhibit flags (e.g., patriotic and/or pertaining to their group affiliation) attached to their motorcycles as they travel down the parade.

There exist several types of flag holders used by motorcyclists to attach flags to their motorcycles. However, as is often the case, though the flags attach to the motorcycles, none are very stable. Often times the flags would be attached to a motorcycle's backrest, luggage rack, various tubular guard bars around the motorcycle (added as accessories), fender sides using brackets, and maybe stick-ons.

A majority of the attachment means for the flag holders are makeshift (using materials such as PVC pipe, straps of various types, and duct tape), aesthetically unappealing (and detracting from the beauty of the motorcycle), and not safe for the operator. These mounts were often times expensive and, in the case of the mount attached to the back fender, have a low center of gravity which negatively affects the controllability of the motorcycle as the wind pulls on the motorcycle when carrying the flag.

A typical flag generally displayed on a motorcycle is about 3 ft. by 5 ft. During parades, the ideal speed for a motorcycle pulling a flag is approximately 5 miles per hour. It is not recommended to go faster than that because of the pull or drag created by the flag. However, most bikers ignore this and go faster anyway. However, as motorcycles build up speed and are carrying a flag or flags attached to the rear of the motorcycle, as the flags sway in the wind, the increased wind resistance on those flags pulls back on the motorcycle or may make the motorcycle shake dangerously back and forth. This negatively affects the safe drivability of the motorcycle and places the rider in dangerous driving conditions.

In addition, as the flags "hang" directly behind the rider, the visibility of the rider is obscured. The flags in this position also cover up the rear lights of the motorcycle creating a dangerous driving condition for motorists behind the motorcycle as they may not be able to see the brake lights or turn signals of the motorcycle.

These existing products do not show very stable flag mounts or safe uses of flag holders. None exist fastened directly to and at the center of gravity portion of the frame of a motorcycle.

There is a need for a sturdy robust flag holder that is aesthetically pleasing and can mount directly to the center of gravity portion of a motorcycle to increase the safety of the rider and that can securely display at least one flag. The present invention allows the rider to display their desired flag or flags in a safe manner.

BRIEF SUMMARY OF THE INVENTION

The present invention overcomes the shortcomings of the prior art. In one embodiment, the flag holder of the present invention is mounted directly to the frame of a motorcycle, e.g., FLH, FLT, or FLR touring model motorcycle, through a flat mounting plate or pad mount. The present invention is a flag holder mount comprising a hollow cylindrical main body having an opening at one end and an end cap with a drainage hole therein at the other end. A pad mount having apertures therein is connected to the cylindrical main body by a connecting bar such as by welding so as to comprise a single piece. Slightly different configurations of the pad mount are necessary to accommodate both the right and left side of the motorcycle.

The present invention (in any of the embodiments), when mounted to the center of gravity portion of the frame of a motorcycle, exhibits two angles. The first angle is away from the motorcycle. The degree of angle away may vary but is generally within the range of between 7° and 15°, and preferably within the range of 10° and 15°. The second angle is a "back angle" (toward the rear of the motorcycle). The degree of back angle may also vary but is generally within the range of between 5° and 15°, and preferably within the range of between 9° and 11°. This back angle increases the aerodynamics of the present invention and allows the rider to ride at an accelerated speed safely while displaying a flag. The present invention is uniquely designed to accommodate multiple flag pole base sizes up to 1.6" or 1 19/32".

Other models of motorcycles exist, e.g., Harley-DavidsonHeritage Softail® FLS, XL and FX models, which cannot readily accept the pad mount due to configurational differences at the mounting point on the motorcycle. Rather than having a mounting block having threaded cavities therein, the motorcycle has foot peg supports extending outward and to which foot pegs are rotatably connected thereto via a pin or bolt. In an alternative embodiment, the flag holder of the present invention may include a post mount comprising a connector having an end that is closed and includes an aperture therein adapted to receive a pin or other comparable fastener to connect the connector of the post mount to the passenger foot peg support. In this embodiment, the post mount used on the right side of the motorcycle is in the same configuration as the post mount used on the left side of the motorcycle.

This embodiment still maintains the two angles described, i.e., away and back. However, only the angle away remains inherent within the flag holder mount and similar to the away angle when using the pad mount. The back angle is now a function of establishing the desired angle when loosening, then threading and tightening the removable passenger foot peg support to maintain the desired angle. The flag holder mount, once mounted, will remain at the back angle the user established when tightening the passenger foot peg support.

There are also models of motorcycles, e.g., Harley-Davidson Sportser® and Dyna® FLD, FXS, FXD, XG and VRS models, wherein the removable passenger foot peg support has a pre-angled support which is forked and curves as the passenger foot peg support extends away from the motorcycle. These models of motorcycles cannot accept a straight post mount. In an alternative embodiment, the flag holder may have a pre-angled connector, or post mount, adapted to receive the pre-angled passenger foot peg support extending from the frame of the motorcycle. In this embodiment, a slightly different configuration of the pre-angled post mount used on the right side of the motorcycle is necessary to accommodate the pre-angled post mount used on the left side of the motorcycle.

The present invention includes several safety features. For example, the flag mount of the present invention is attached directly to the frame of the motorcycle at the center of the motorcycle rather than at the end of the back fender providing a more solid and stable foundation for the flag mount. The two angles (away and back) of the flag mount of the present invention allow for faster acceleration and travel of the motorcycle without risking damage to the motorcycle. Because of the angles of the flag mount, and the degree of the flag position, when the motorcycle stops, the flag lays behind and out of the user's vision and way.

The calculated design angles of the present invention keep the "flag hang" away from the motorcycle during stops and full flag-waving operation. Further, the customary steering wobble caused by a waving flag (attached to the rear of the motorcycle) creating control issues are eliminated at customary speeds creating a safer ride. This is because the present invention has been uniquely designed to mount in front of the rear wheel with an increased centered point of gravity. There is also improved visibility for motorists behind the user to the user's position during braking and emergency use of flashers due to the highly improved flag position on the motorcycle, i.e., there is no visual obstruction of signal or warning lights.

In addition, no drilling or changes to a user's motorcycle are required, thereby maintaining the integrity and strength of the original equipment. The present invention mounts directly to the motorcycle utilizing the existing frame bolt holes or passenger foot peg support posts of many different models of motorcycles. The present invention may even be retrofitted to any touring frame-type motorcycle, including Harley-Davidson models, going back to models at least as early as 1982, as well as more recent trike models. Once installed, the present invention enhances the look of the motorcycle. As such, the present invention may be left attached either permanently or can be taken on and off as desired.

BRIEF DESCRIPTION OF THE SEVERAL VIEWS OF THE DRAWINGS

FIG. 2A depicts the right side of a motorcycle showing the passenger foot peg. FIG. 2B depicts an embodiment of the present invention mounted to the right side of a motorcycle after removal of the passenger foot peg.

DETAILED DESCRIPTION OF THE INVENTION

Figure 1:
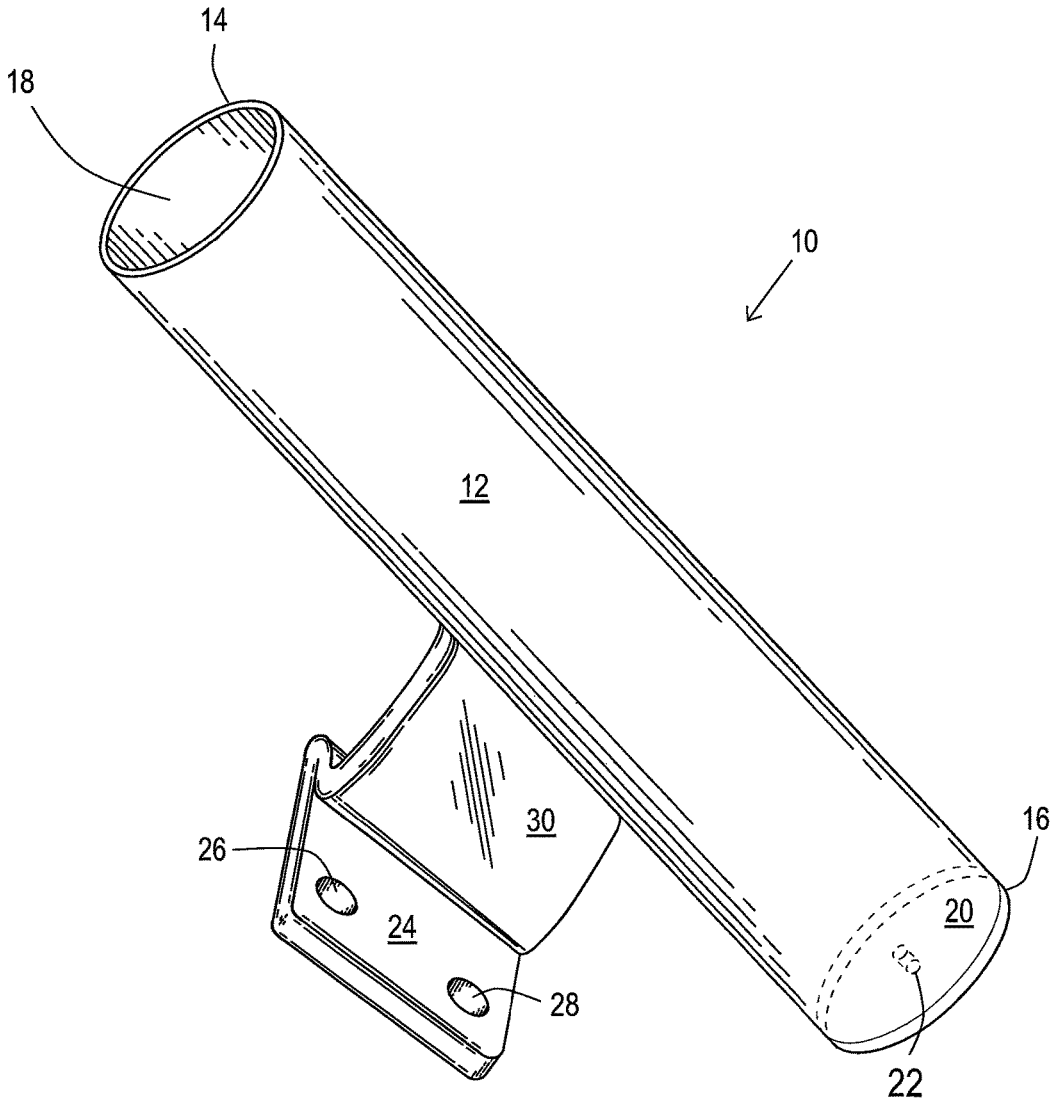
FIG. 1 is a perspective view of an embodiment of the present invention.

Referring now to FIG. 1, flag mount 10 is comprised of a flag holder or cylindrical main body 12 having end 14 and end 16. Cylindrical main body 12 is hollow and has an opening 18 at end 14. End cap 20 having drainage hole 22 is attached to end 16 of cylindrical main body 12. Pad mount 24 has apertures 26 and 28. Connecting bar 30 connects pad mount 24 to cylindrical main body 12 so as to comprise a single piece.

Figure 2A:
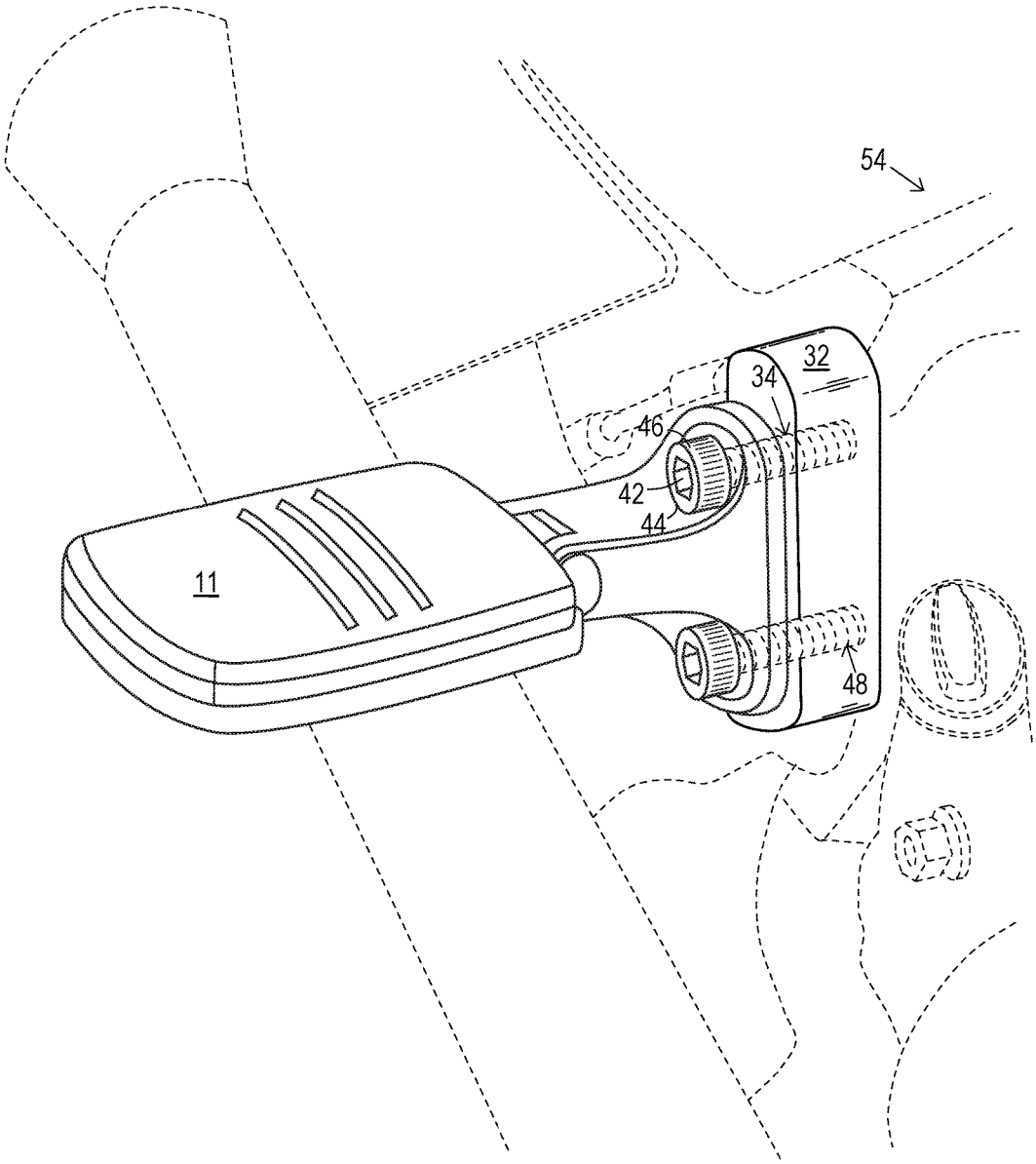
FIGS. 2A and 2B are perspective views.
Figure 2B:
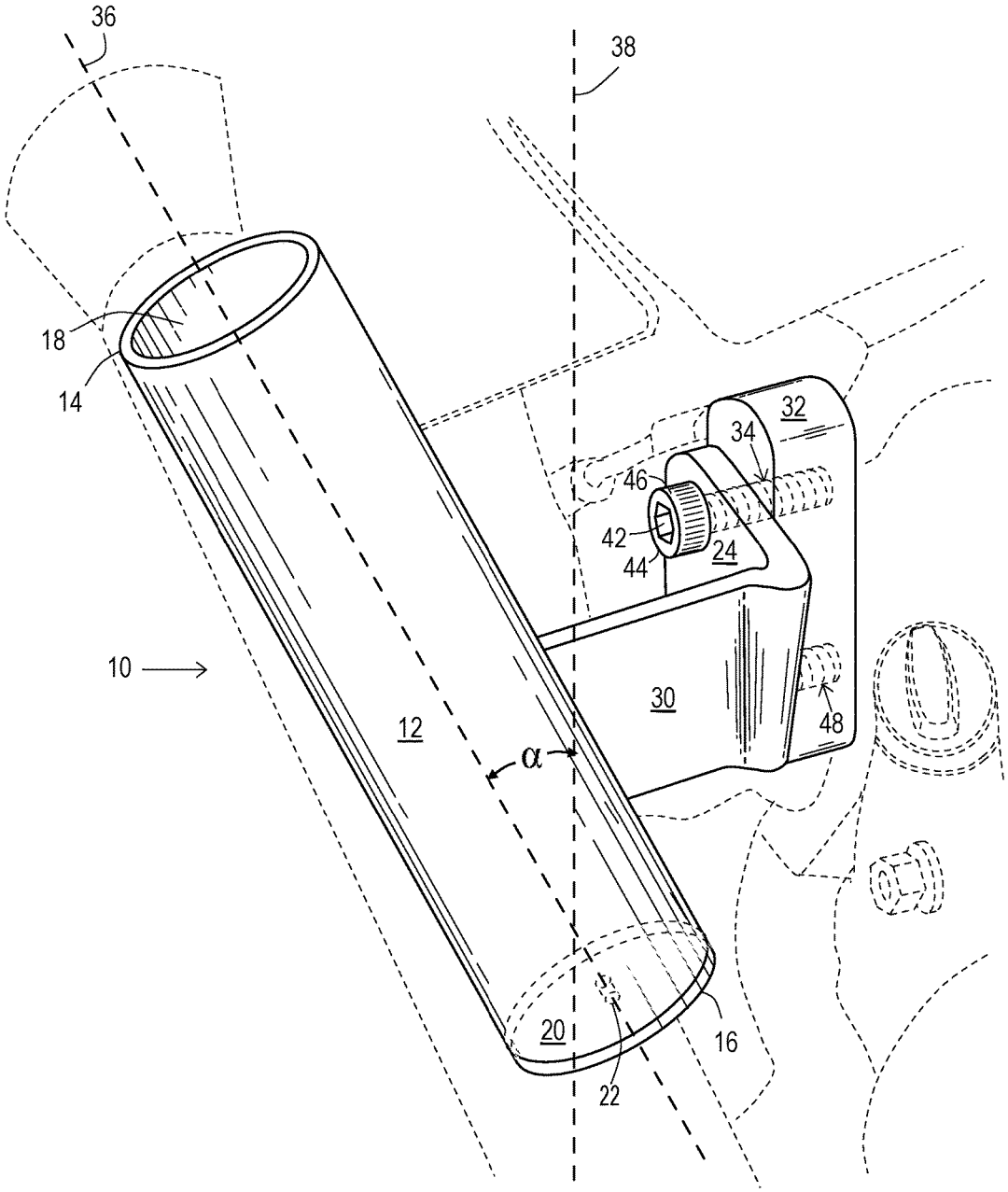

Referring now to FIG. 2A, passenger foot peg 11 is shown mounted to mounting block 32 on the right side of motorcycle 54. Passenger foot peg 11 is removed to allow installation of flag mount 10. Referring now to FIG. 2B, flag mount 10 is shown mounted to mounting block 32 on the right side of motorcycle 54. The installation of flag mount 10 occurs at the same location, i.e., mounting block 32, on motorcycle 54 where the passenger foot peg 11 is located. The passenger foot peg 11 is removed from mounting block 32 exposing threaded cavities 40*a*-40*d* (see FIG. 3).

Fasteners 34 and 48 traverse pad mount 24 and thread into selected threaded cavities 40*a*-40*d* (see FIG. 3), as described in further detail below, to securely mount flag mount 10 to mounting block 32 of motorcycle 54. Fasteners 34 and 48 can be bolts or other comparable types of fasteners. The present invention uses a ⅜"×16"×1" stainless bolt having Allen head cap 44. The outer circumference of the top of Allen head cap 44 is smooth and has hex shaped cavity 42 on the inside top center portion of Allen head cap 44. Hex shaped cavity 42 is adapted to receive an Allen wrench (not shown). The outer circumference of Allen head cap 44 may be knurled 46. Threading is along the length of the bolt. This configuration is the same for fasteners 34 and 48. This type of bolt is commercially available and commonly known as a "cap screw."

Still referring to FIG. 2B, flag mount 10 angles away from motorcycle 54. The degree of angle α—which is the angle between longitudinal axis 36 through cylindrical main body 12 relative to vertical axis 38—may vary but is generally within the range of between 7° and 15°, and preferably within the range of 10° and 15°. When flag mount 10 is in this angled orientation, drainage hole 22 is located at the center portion of end cap 20 of cylindrical main body 12, as shown in FIG. 2B.

Figure 3:
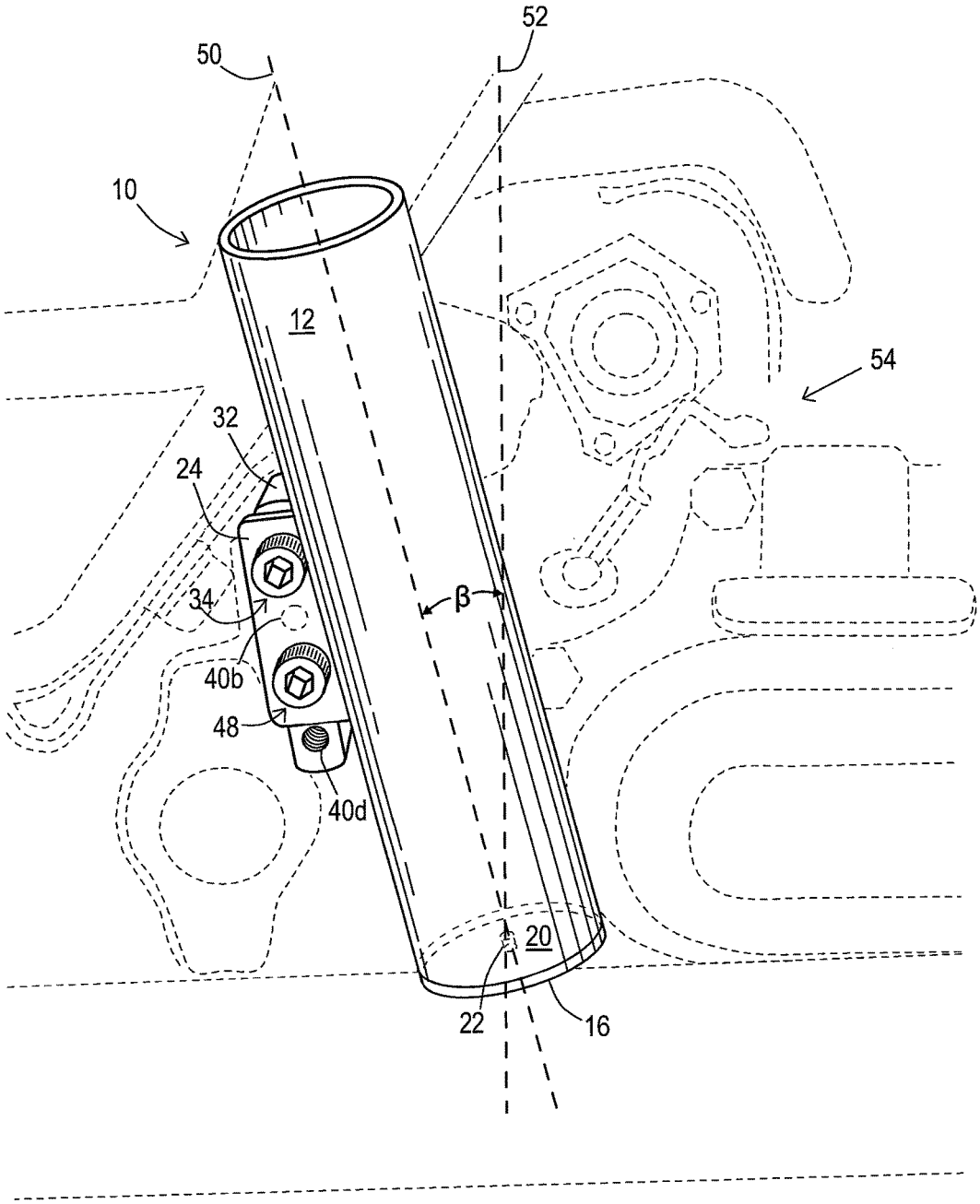
FIG. 3 is an elevated view of an embodiment of the present invention mounted to the right side of a motorcycle.

In addition to flag mount 10 angling away from motorcycle 54, as shown in FIG. 2B, flag mount 10 also angles back (toward the rear of motorcycle 54). Referring now to FIG. 3, back angle β of flag mount 10 relative to the vertical axis is shown. Mounting block 32 contains threaded cavities 40*a*-40*d* adapted to receive fasteners 34 and 48. FIG. 3 shows fasteners 34 and 48 threaded into threaded cavities 40*a* and 40*c* (not shown). Threaded cavities 40*b* and 40*d* are not used in this configuration. However, if the user desires to lower the mounting location of flag mount 10, the user may secure pad mount 24 to mounting block 32 using the lower positioned cavities 40*b* and 40*d*. The degree of back angle β—that longitudinal axis 50 of flag mount 10 angles back relative to vertical axis 52—may vary but is generally within the range of between 5° and 15°, and preferably within the range of between 9° and 11°.

Figure 4:
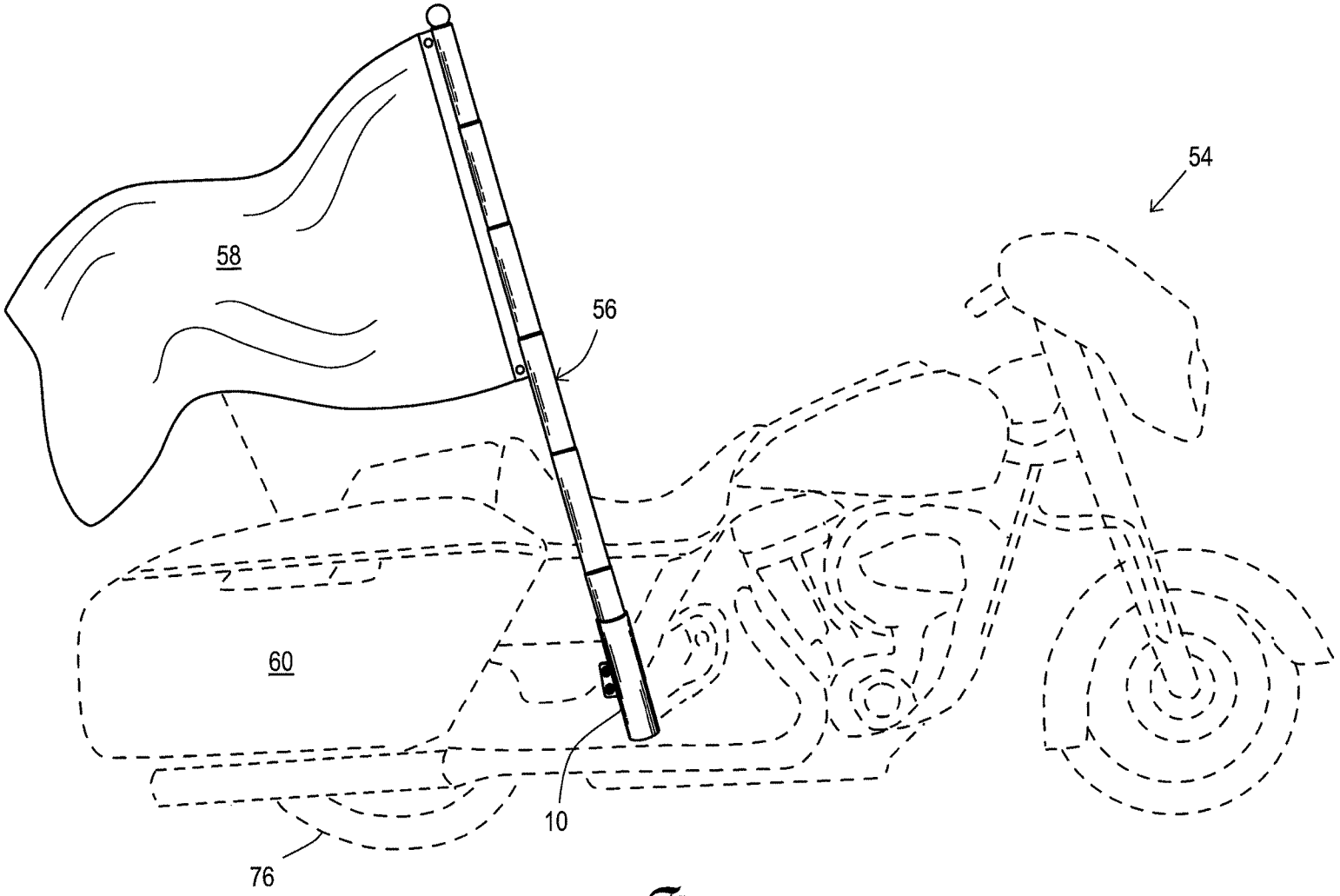
FIG. 4 is an environmental view of an embodiment of the present invention mounted to the right side of a motorcycle.

Referring now to FIG. 4, the present invention is shown as it would appear mounted on the right side of motorcycle 54. Flag mount 10 is mounted directly to the frame of motorcycle 54 in front of rear wheel 76 at the same location where foot peg 11 is located (see FIG. 2A). This mounting location is at the center of gravity for motorcycle 54. Telescopic pole 56 is extended to its full length and follows back angle β of flag mount 10 (see FIG. 3). Flag 58 is attached to telescopic pole 56 at the appropriate locations and using appropriate fastening means. Flag 58 and telescopic pole 56 are then inserted within cylindrical main body 12 of flag mount 10 and are securely held in place.

Referring now to FIGS. 3 and 4, the degree of angle back of flag mount 10 with respect to vertical axis 52 is generally in the range of about 5°-15°. However, it is common for motorcycle 54 to be equipped with saddlebags 60 as these provide areas in which the motorcyclist may store belongings and personal items during transport. Saddlebags 60 (only one of which is shown) are two bags hung over either side of motorcycle 54 just behind the seat. Saddlebags 60 may be manufactured of various materials, including leather and fiberglass.

If motorcycle 54 tips or falls over, the fall may likely damage saddlebags 60, which in the case of saddlebags made of fiberglass, becomes an expensive repair. To minimize against this damage, a protective bar (sometimes called a crash bar) (not shown) goes around saddlebag 60. This protective bar protrudes out in front of saddlebag 60 and takes up space between saddlebag 60 and where flag mount 10 is going to be angling back. The angle of flag mount 10 when positioned in the installed configuration is such that flag mount 10 (and telescopic pole 56 and flag 58) do not interfere with but instead clear major components, such as the protective or crash bar (if the motorcycle has one) as well as saddlebags 60 of motorcycle 54, as shown in FIG. 4.

Figure 5:
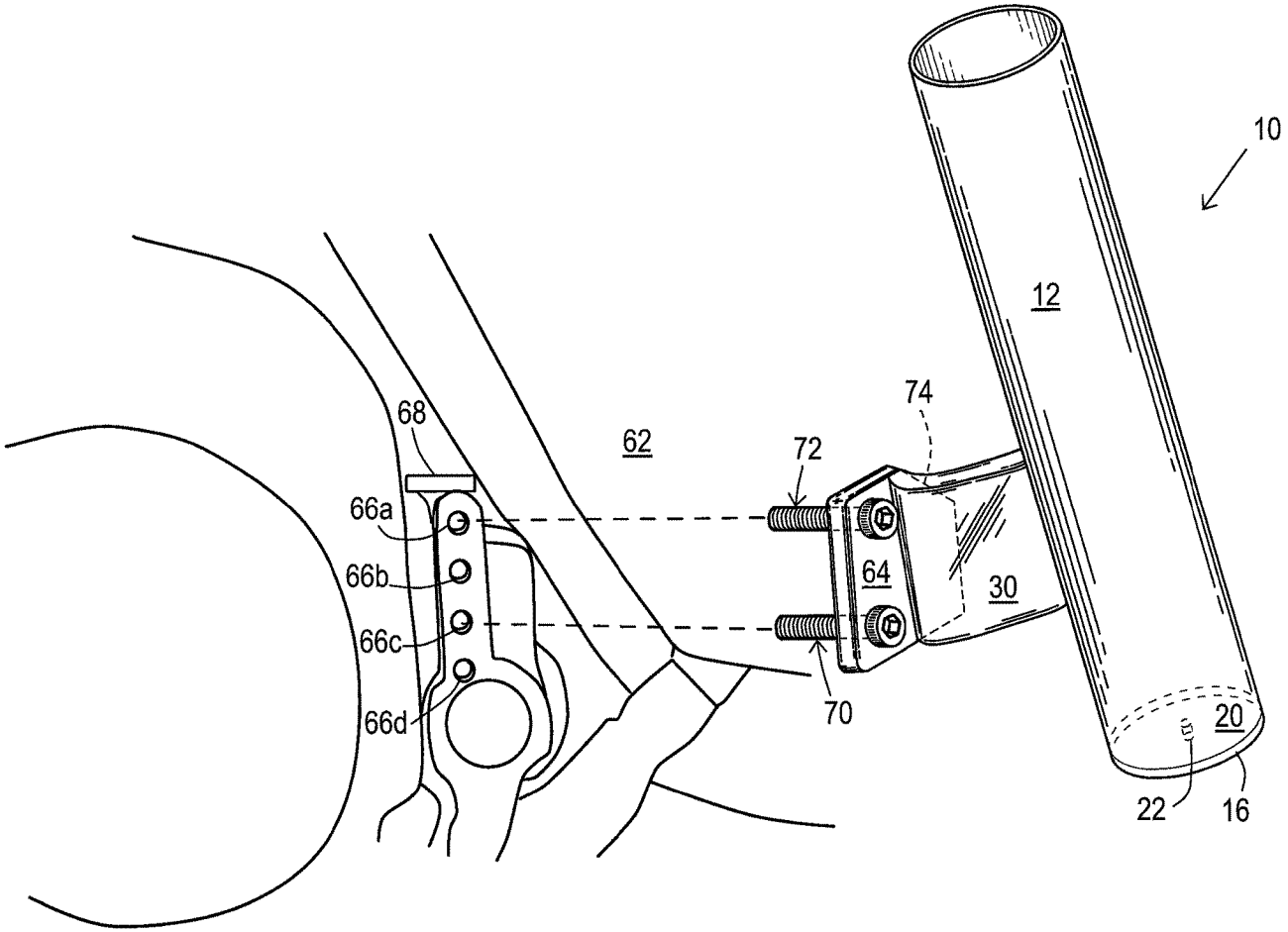
FIG. 5 shows an exploded perspective view of an embodiment of the present invention mounted to the left side of a motorcycle.

With some variation in the shape configuration, passenger foot peg 11 is in a substantially similar location on the opposite (left) side of motorcycle 54. Turning now to FIG. 5, the area where flag mount 10 mounts to the left side of motorcycle 54 is shown. FIG. 5 illustrates the left side of an FLH, FLT, or FLR model motorcycle frame after the left foot peg (not shown) previously attached to mounting block 68 has been removed from mounting block 68 exposing threaded cavities 66*a*-66*d* therein. Motorcycle component cover 62 requires the shape or configuration of pad mount 24 for this left side be configured differently.

This left side area is constricted or limited by motorcycle component 62 and does not provide sufficient space for mounting of the quadrilaterally configured pad mount 24. As such, it is necessary to modify the configuration of pad mount 24. For mounting flag mount 10 to the left side of motorcycle 54, left side angled pad mount 64 having a plurality of apertures therein is used. Left side angled pad mount 64 contains angle 74 which will clear motorcycle component 62 and allow flag mount 10 to be securely mounted to mounting block 68 via fasteners 70 and 72 threaded into threaded cavities 66*a* and 66*c*. However, if the user desires to lower the mounting location of flag mount 10, the user may secure left side angled pad mount 64 to mounting block 68 using the lower positioned threaded cavities 66*b* and 66*d*.

The flag holder mount of the present invention is comprised of a durably, light weight and resistant metal such as aluminum. However, other comparable materials, such as steel, may also be used. Cylindrical main body 12 is 9" in length and has an outer diameter (OD) of 1.9" and an inner diameter (ID) of 1.61". The wall thickness of the cylindrical main body 12 is 0.145" and is consistent throughout the length of the cylindrical main body 12. Opening 18 of cylindrical main body 12 is larger than most flag poles to accommodate various sizes.

The dimensions of connecting bar 30 are 2"×2"×1½". The dimensions of pad mount 24 are 2½"×2"×⅜". The dimensions of apertures 26 and 28 within pad mount 24 of the present invention are 7/16" and, when plated, will accommodate a ⅜" bolt or pin. While the present invention uses these dimensions, it is contemplated that other dimensions may be used and still be within the contemplation of the present invention.

When the present invention is mounted directly to and at the center of gravity portion of the frame of motorcycle 54, the optimal dual angles (away and back) are such that the rider may enjoy a secure and safe riding experience while proudly and safely displaying the rider's desired flag. Pad mount 24, connecting bar 30, and cylindrical main body 12 may be all welded together to make a single piece. Alternatively, flag mount 10 may be cast from a single die so as to have a single piece.

Figure 6:
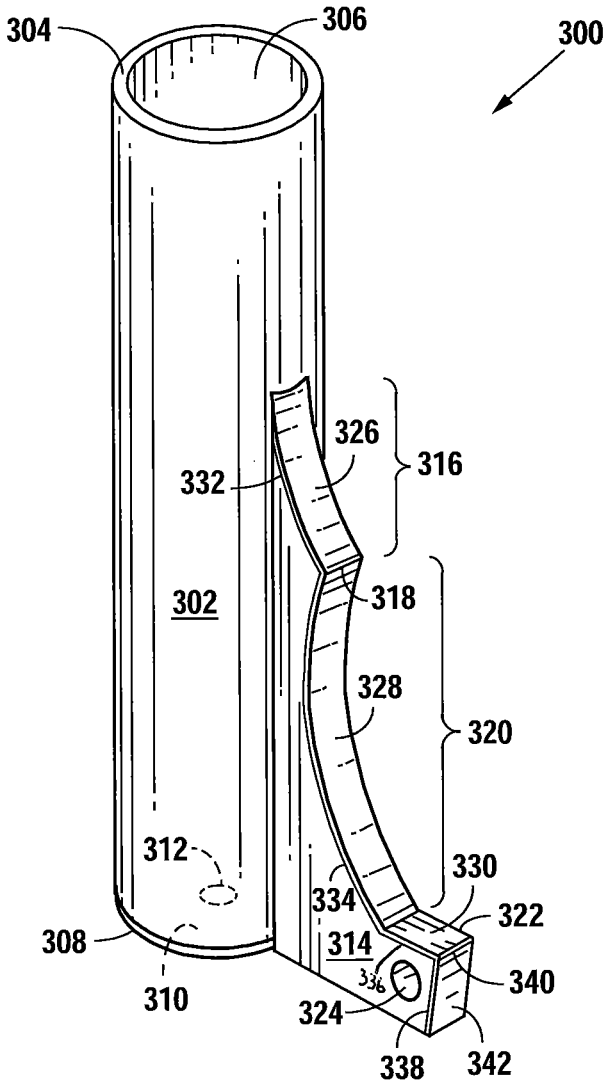
FIG. 6 is a perspective view of an embodiment of the present invention.

Referring now to FIG. 6, an alternative embodiment of the present invention is shown. Flag mount 300 is comprised of a flag holder or cylindrical main body 302 having end 304 and end 308. Cylindrical main body 302 is hollow and has an opening 306 at end 304. End cap 310 having drainage hole 312 is attached to end 308 of cylindrical main body 302.

Post mount bracket 314 provides additional strength to post mount 322. Post mount bracket 314 connects at one end to cylindrical main body 302, e.g., via welding or other comparable attachment means, so as to comprise a single piece. Post mount bracket 314 is integrated into cylindrical main body 302, providing additional strength. Post mount bracket 314 has a plurality of curves along the opposite end. Short curve 316 has beveled edge 332 and surface 326 and curves out from cylindrical main body 302 to vertex 318. Long curve 320 follows. Long curve has beveled edge 334 and surface 328 and curves inward from vertex 318 toward cylindrical main body 302 before curving out to post mount 322.

Post mount 322 has beveled edge 336 along top surface 330 and beveled edge 340 between top surface 330 and front surface 342. Post mount 322 also has beveled edge 338 along front surface 342. Aperture 324 traverses center of post mount 322 and is adapted for accepting a pin (not show) or other comparable fastener to secure post mount 322 within the forked ends of the foot peg support (not shown) extending from motorcycle 54 (not shown).

Figure 7A:
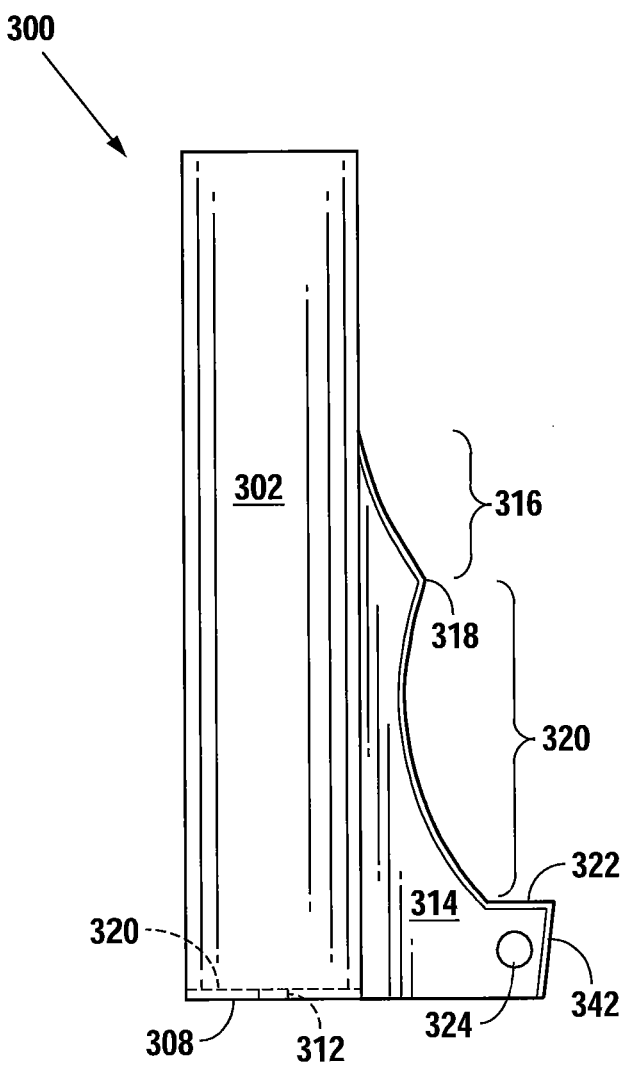
FIG. 7A is a side elevated view of an embodiment of the present invention.
Figure 7B:
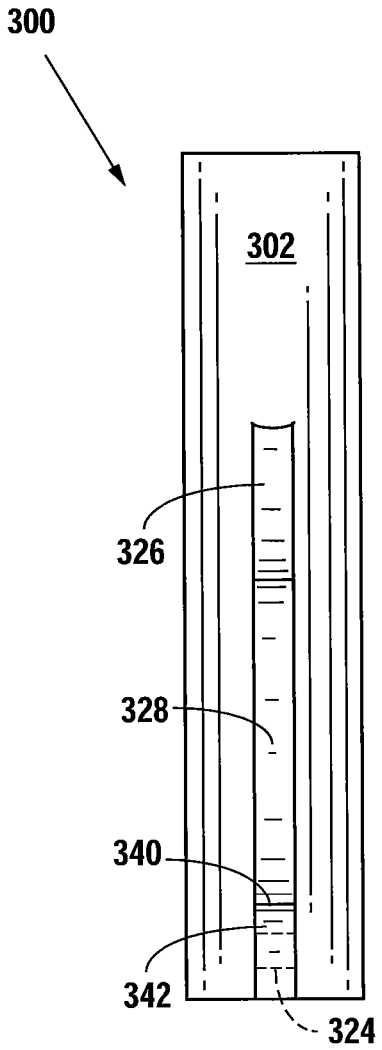
FIG. 7B is a front elevated view of an embodiment of the present invention with reference to FIG. 7A.

Referring now to FIG. 7A, bottom end 308 of cylindrical main body 302 lies within the same horizontal plane as the bottom end of post mount bracket 314 and post mount 322. Front surface 342 (FIG. 6) of post mount 322 is at a slight acute angle, though the present invention also contemplates that front surface 342 may also be transverse to the horizontal plane along the bottom of post mount bracket 314 and post mount 322. Drainage hole 312 is centered in end cap 310 (FIG. 6). FIG. 7B illustrates a front view of flag mount 300.

Post mount bracket 314 is 0.5" in thickness and is made of aluminum, though other comparable metal may be used. Cylindrical main body 302 is 9" in length and has an OD of 1.9" and an ID of 1.61". Aperture 324 is 7/16" and, when plated, will accommodate a ⅜" bolt or pin. The single bolt (not shown) that secures flag mount 300 (via post mount 322) to passenger foot peg (not shown) is a ⅜"×13/16"×1¼"

stainless clevis pin with a fastener, such as a ⅜" "E" type retaining ring, or other comparable fastener.

Referring back to FIGS. 1, 2B, 3 and 5, drainage hole 22 preferably is located towards the center point of cylindrical main body 12 of flag holder 10 when flag holder 10 is attached to motorcycle 54 such that any water or moisture that accumulates—e.g., from rain, condensation or other precipitation—is allowed to drain out. In one embodiment, for example, drainage hole 22 is located at the center of end 16 where flag mount 10 is in an angled configuration when mounted on motorcycle 54, as shown in FIGS. 2B, 3 and 5.

Similarly, and referring now to FIGS. 6, 7A-7B, in an alternative embodiment, drainage hole 312 is also located at the center of end cap 310. The water drainage hole of the present invention of all embodiments is 5/16" round. However, other comparable sizes of drainage hole may also be employed and still be within the contemplation of the present invention.

The present invention may be powder coated which is a process where the paint is baked on. This can be done for aesthetic reasons (e.g., the user does not like chrome). In one embodiment (see FIG. 6, 7A-7B), a small area surrounding post mount 322 will be masked during the powder coat process. Masking on this embodiment only allows the small masked area to slide in and out of the forked ends of the foot peg support (not shown) extending from motorcycle 54 (not shown) without scratching the powder coat and also allows a builder to use standard ½" size aluminum to fit without machining for proper fit (so that machining of this component, i.e., post mount 322, is no longer necessary). Another advantage in this process is that it is unnecessary for the builder to calculate coating thickness—which may vary from unit to unit—and the fit is exact every time for the user when installing the present invention.

Alternatively, the flag mount may be chromed which adds a protective coating that also matches the motorcycle. Both types of finish are aesthetically pleasing depending on the user's taste.

An accessory that may be included with the present invention includes a telescopically extendable flag pole for fastening of a flag thereto.

Referring back to FIGS. 2A, 2B, 3 and 5, in one embodiment, to install the flag mount of the present invention onto an FLH, FLT, or FLR frame model-type motorcycle, the passenger foot pegs 11 (only the right side of which is shown; the left side being substantially similar) are removed. Apertures 26, 28 of pad mount 24 are then aligned with corresponding exposed threaded cavities 40*a* and 40*c* or 40*b* and 40*d* (depending on the desired height of the flag mount) and fastened thereto with bolts or other similar fasteners. If the flag mount is desired to be mounted at a higher position, then apertures 26, 28 are aligned with and fastened to exposed threaded cavities 40*a* and 40*c*, as shown in FIG. 3. If a lower position is desired, apertures 26, 28 are aligned with and fastened to exposed threaded cavities 40*b* and 40*d*.

Similarly, on the left side, fasteners 70 and 72 are aligned with and threaded into exposed threaded cavities 66*a* and 66*c*, securing left side angled pad mount 64 to the frame of motorcycle 54. If a lower position is desired, fasteners 70 and 72 are aligned with and threaded into exposed threaded cavities 66*b* and 66*d*.

In another embodiment, to install the present invention onto the frame of a motorcycle which cannot readily accept the pad mount due to configurational differences at the mounting point on the motorcycle, the foot peg support extending outward (and to which foot pegs are rotatably connected thereto via a pin) are removed. A pin or other comparable fastener traverses post mount 322 and secures post mount 322 within the forked ends of the foot peg support (not shown) extending from motorcycle 54 (not shown).

In yet another embodiment, to install the present invention onto the frame of a motorcycle which cannot readily accept foot peg support extending linearly outward because the removable foot peg support is forked and curves, or angles, as the foot peg support extends away from the motorcycle, a pin or other comparable fastener traverses the pre-angled post mount and secures the pre-angled post mount within the forked ends of the foot peg support extending from the motorcycle.

When mounted to the appropriate model motorcycle, the present invention is uniquely designed to accommodate multiple flag pole base sizes up to 1.9" or 1 15/16". Thus, for example, motorcycle 54 may contain and safely and securely display two flags, one on either side, via the appropriately configured pad mount (i.e., either pad mount 24 or left side angled pad mount 64) depending on what side each flag is mounted.

The present invention is available as a stand-alone product. The present invention is also available in a kit such that the user will have all components available in one location. The kit includes sizing tape, which may be one inch wide and 30 ft. long. The sizing tape is used to wrap the very bottom portion of the flag pole and about an inch below the top of the cylindrical holder to take up the space between the flag holder and the inside portion of the cylindrical holder to maintain the flagpole securely therein. The kit also includes an "E" type retaining ring. An "E" type retaining ring will already be available from the foot peg support already on the motorcycle. However, during the installation process, should the user bend or break the original "E" type retaining ring, a spare is included in the kit.

The kit also includes a telescopic flag pole which, when not in use, can fit in the saddlebag or, alternatively, can be left in the holder as the telescopic flag pole will not extend out too much further than the holder. The telescopic flag pole is much safer to use with the present invention when transporting without the flag. This is especially the case when motorcycle enthusiasts have to carry home a full-sized flagpole without the flag for several miles once an event, e.g., parade, is over.

The various embodiments described herein may be used singularly or in conjunction with other similar devices. The present disclosure includes preferred or illustrative embodiments of specifically described apparatuses, assemblies, methods and systems. Alternative embodiments of such apparatuses, assemblies, methods and systems can be used in carrying out the invention as claimed and such alternative embodiments are limited only by the claims themselves. Other aspects and advantages of the present invention may be obtained from a study of this disclosure and the drawings, along with the appended claims.

I claim:

1. A method of mounting a flag holder mount onto a motorcycle, the method comprising the steps of:

locating the motorcycle having at least one foot peg mounted on a mounting block on the frame of said motorcycle, said foot peg located at the center of gravity portion of said motorcycle;

removing said at least one foot peg from at least one side of said motorcycle;

exposing a plurality of threaded cavities on said mounting block;

mounting at least one flag holder mount at a mounting point directly to the frame of said motorcycle, said mounting point being the center of gravity portion of said motorcycle and wherein said flag holder mount comprises:

a cylindrical main body having a first end and a second end;

a mounting plate having a plurality of apertures; and a rigid connecting member having a first end and a second end, said first end of said connecting member connected to said cylindrical main body and said second end of said connecting member connected to said mounting plate; and wherein said connecting member is of a consistent width between said cylindrical main body and said mounting plate;

securing a flag pole to said flag holder mount; and fastening a flag onto said flag pole at a distal location relative to said at least one flag holder mount.

2. The method of mounting a flag mount holder onto a motorcycle, as recited in claim 1, wherein said mounting step further comprises aligning a plurality of fasteners traversing said plurality of apertures of said mounting plate with corresponding selected said plurality of threaded cavities.

* * * * *